US006960109B2

(12) United States Patent
Miura et al.

(10) Patent No.: US 6,960,109 B2
(45) Date of Patent: Nov. 1, 2005

(54) ENGINE INTAKE STRUCTURE FOR A BOAT

(75) Inventors: Takayoshi Miura, Saitama (JP); Jun Nakajima, Saitama (JP); Tadaaki Nagata, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/932,012

(22) Filed: Sep. 2, 2004

(65) Prior Publication Data

US 2005/0085142 A1 Apr. 21, 2005

(30) Foreign Application Priority Data

Sep. 9, 2003 (JP) ..... 2003-317277

(51) Int. Cl.[7] ..... B63H 21/10
(52) U.S. Cl. ..... 440/88 A
(58) Field of Search ..... 123/184.21, 196 P; 440/88 A

(56) References Cited

U.S. PATENT DOCUMENTS 5,699,763 A * 12/1997 Phillips et al. ..... 123/184.21
6,092,498 A * 7/2000 Lohr et al. ..... 123/90.38
6,098,586 A * 8/2000 Bloomer ..... 123/184.21

FOREIGN PATENT DOCUMENTS

JP 2003-002292 A 1/2003

* cited by examiner

*Primary Examiner*—Stephen Avila

(74) *Attorney, Agent, or Firm*—Birch Stewart Kolasch & Birch LLP

(57) ABSTRACT

An engine intake structure for a small boat arranged in a comparatively small space. The structure includes an intake box having an upper intake section facing one or more intake ports, and a lower intake section extending downwards from the upper intake section. The upper intake section and the lower intake section are partitioned by a mesh member. An air cleaner element is arranged in an extension section of the lower intake section, so that, after external air flows into the lower intake section via the air cleaner element, the air flows to the upper intake section, and then into the intake ports.

20 Claims, 11 Drawing Sheets

ENGINE INTAKE STRUCTURE FOR A BOAT

CROSS-REFERENCE TO RELATED APPLICATION

The present application is related to Japanese Patent Application No. 2003-317277, file on Sep. 9, 2003, the entire contents of which are hereby incorporated by reference.

BACKGROUND OF THE INVENTION

1. Field of the Invention

The present invention relates to an engine intake structure for a small boat, and particularly to an engine intake structure for a small boat having intake pipes extending sideways from cylinders provided in the engine, and these intake pipes being housed inside an intake box.

2. Description of Background Art

As a small boat for gliding over the surface of the sea or a lake, there is a known a small propelled boat driven having a water jet propulsion unit attached to the rear of the boat body. The boat is driven by taking in water from the bottom of the boat using the water jet propulsion unit and spraying the taken in water to the rear. This small boat is provided with an engine intake structure for taking in external air into an intake box, and introducing the taken in external air to intake pipes, as a structure for introducing air into a cylinder. See for example, Japanese patent Laid-open No. 2003-2292.

FIG. 13 is a reproduction of FIG. 7(*a*) of patent Japanese patent Laid-open No. 2003-2292. However, the reference numerals have been changed. The engine intake structure 200 of the small boat has four intake passages 202 . . . (only one is shown in the drawing) extending above a four cylinder engine 201, respective porous members 204 (in the following called "mesh members") attached to intake opening 203 . . . of these intake passages 202 . . . , with the respective intake openings 202 . . . being arranged inside an intake box 205, and this intake box 205 is attached to an upper part of the engine 201 with an air cleaner element 206 being housed inside the intake box 205 and the intake box 205 being covered by a cover 207.

With the engine intake structure 200 for the small boat, air is introduced from an external air introduction opening 208 of the intake box 205, and the introduced air passes through the air cleaner element 206 and is introduced to the inside of the intake box. The introduced air is introduced to the intake opening 203 . . . through the mesh members 204 . . . , and introduced into the intake pipes 202 . . . from the intake openings 203 . . . .

The air cleaner element 206 is housed inside the intake box 205, and external air passes through the air cleaner element 206 and is introduced into the intake box 205. In this way, dust particles etc. in the air are removed by the air cleaner element 206, and that air is introduced into the intake box. Also, mesh members 204 . . . are attached to the intake openings 203 . . . of the intake pipes 202 . . . , to form a flame arrester.

Here, in the engine intake structure 200 for a small boat, the air cleaner element adopts a cylindrical shape, but the air cleaner element 206 is comparatively large. As the air cleaner element 206 is housed inside the intake box 205, the intake box becomes large. As this large intake box 205 is incorporated into the boat body of a small boat, it is necessary to ensure a comparatively large space inside the boat body.

However, since the engine 201 and various components are arranged inside the boat body of the small boat, it is difficult to ensure a comparatively large space inside the boat body. Therefore, in order to ensure space for attachment of the large intake box 205, studies to determine layout (arrangement) of various components take time, and this hinders increase in productivity.

SUMMARY AND OBJECTS OF THE INVENTION

The present invention is intended to provide an engine intake structure for a small boat having an intake box arranged in a comparatively small space, by making the intake box smaller.

With a first aspect of the present invention, an engine intake structure for a small boat includes an engine mounted substantially in the middle of a boat body in the widthwise direction, so as to face in a longitudinal direction of the boat body. A plurality of cylinders of the engine is arranged facing upwards, with intake pipes extending to the side from these cylinders, intake ports of these intake pipes being housed inside an intake box and the intake box being arranged between a side wall of the boat body and the engine. An upper intake section facing towards the intake ports and a lower intake section extending downwards from the upper intake section are provided in the intake box. The upper intake section and lower intake section are partitioned by a mesh member, an air cleaner element is arranged in the lower intake section, and after external air has been taken in to the lower intake section via the air cleaner element, the air flows to the upper intake section.

An upper intake section and a lower intake section extending downwards from the upper intake section are provided in the intake box, and the upper intake section and lower intake section are partitioned by a mesh member. Intake pipe intake openings are housed in the upper intake section, and an air cleaner element is housed in the lower intake element. In this way, by providing the upper intake section and lower intake section and extending the intake box in a vertical direction, the intake box provided with the mesh member and the air cleaner element can be arranged in a comparatively small space between a side wall of the boat body and the engine (cylinders).

Also, by arranging the intake box in a comparatively small space, when determining the arrangement of components, it is not necessary to ensure a large space for the intake box. Thus, it is possible to easily determine layout of components without substantial time or effort.

According to a second aspect of the present invention, an engine intake structure for a small boat includes an engine mounted substantially in the middle of a boat body in the widthwise direction, so as to face in a longitudinal direction of the boat body. A plurality of cylinders of the engine is arranged facing upwards, with intake pipes extending to the side from these cylinders, intake ports of these intake pipes being housed inside an intake box and this intake box being arranged between a side wall of the boat body and the engine. The intake box constitutes an extension section extending either backwards or forwards from the intake pipes, an insertion opening is provided in an upper part of the extension section, a plate-shaped air cleaner element is substantially vertically inserted into the intake box from the insertion opening and in a state where this air cleaner element is inserted into the intake box. The air cleaner element is pressed to the intake box by a cam member, and the cam member is operated by operation means close to the insertion opening.

An insertion opening is provided in an upper part of the extension section, and a plate shaped air cleaner element is inserted into the intake box in a substantially vertical direction from this insertion opening. Therefore, by arranging the plate-shaped air cleaner element so as to run along the engine, the thickness of the intake box is kept small, and it is possible to make the intake box smaller.

By keeping the width of the intake box small, it becomes possible to arrange the intake box in a comparatively small space between the side wall of the boat body and the engine. Therefore, when determining arrangement of components, since it is not necessary to ensure a large space for the intake box, it is possible to easily determine arrangement of components without substantial time of effort.

Also, by inserting the plate-shaped air cleaner element from the insertion opening substantially vertically, it becomes possible to keep the insertion opening small. In this way, the cover for covering the insertion opening is made small, and it is possible to easily attach and detach the cover. In addition, the cam member is operated by operation means close to the insertion opening. By operating the cam member close to the insertion opening, it is possible to simplify both the operation of pressing the air cleaner element to the intake box as well as the operation of opening a presser of the air cleaner element.

According to a third aspect of the present invention, intake pipes extend in a sideways direction from the cylinders and are housed in the intake box. The intake pipes are bent so as to run along a sidewall of the boat body.

By making the intake pipes extending in a sideways direction from the cylinders bent so as to run along a side wall of the boat body, it is possible to keep the width of a space where the intake pipes are arranged small.

According to a fourth aspect of the present invention, the intake pipes are bent forwardly and upwardly with respect to the boat body.

By bending the intake pipes forwardly and upwardly with respect to the boat body, intake openings of the intake pipes are arranged at a high position. Thus, it is difficult for sea water or water to enter from the intake openings.

With the first aspect of the present invention, there is the advantage that an intake box provided with a mesh member and an air cleaner element can be efficiently arranged in a space between a sidewall of a boat body and a cylinder. There is also an advantage that when determining arrangement of components, it is possible to improve productivity by keeping investigation time short.

With the second aspect of the present invention, there is an advantage that when determining arrangement of components it is possible to improve productivity by keeping investigation time short. There is also the advantage that, since attaching and detaching the cover is simplified, and pressing/press opening of the air cleaner element are also simplified, attaching and detaching the air cleaner element does not take a lot of effort and can be carried out in a short time.

With the third aspect of the present invention, there is an advantage that by keeping the width of a space in which the intake pipes are arranged small, it is possible to easily ensure a space for arrangement of the intake pipes.

With the fourth aspect of the present invention, there is an advantage that by arranging intake openings of the intake pipes at a high position, it is possible to prevent sea water or water entering from the intake openings.

However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
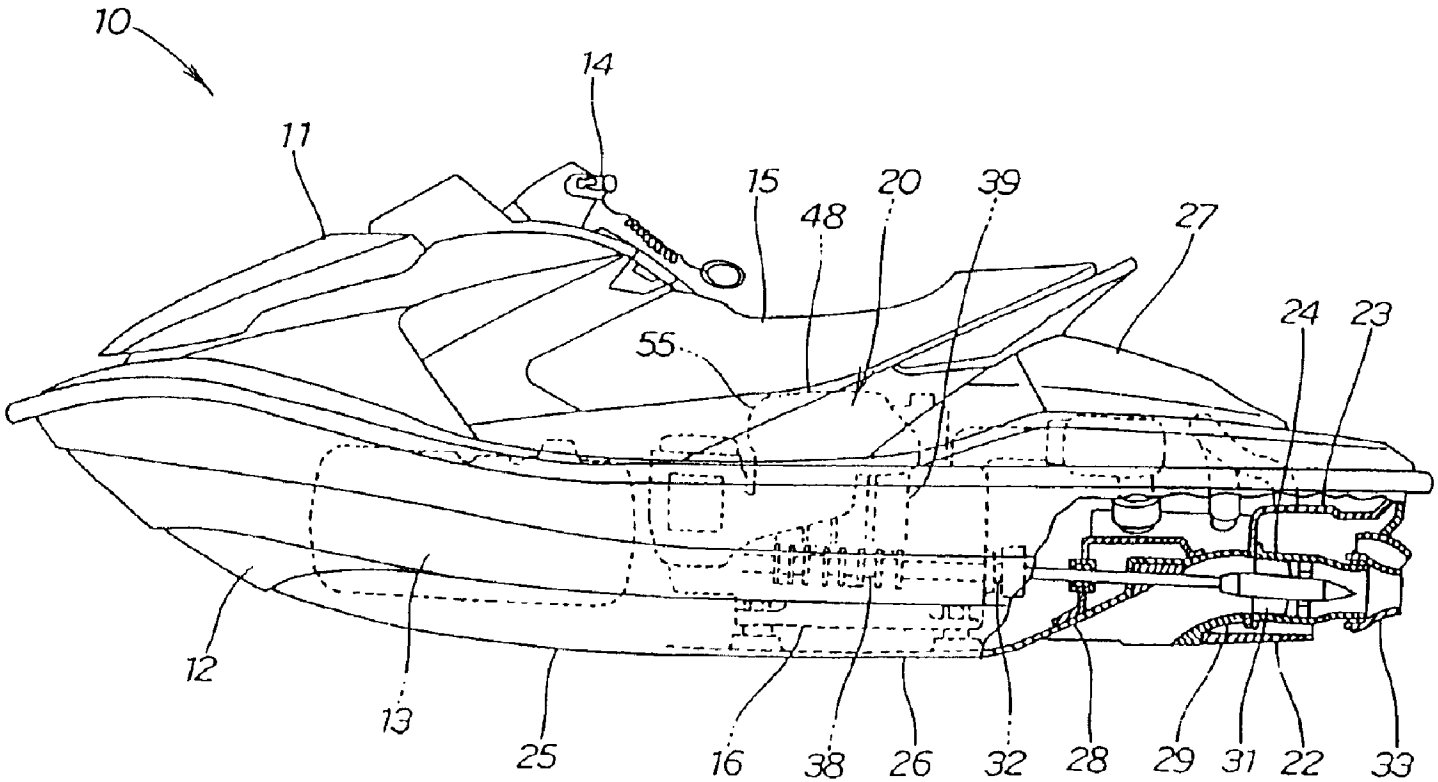
FIG. 1 is a side view of a small boat provided with the engine intake structure of the present invention.

FIG. 1 is a side view of a small boat provided with the engine intake structure of the present invention. The small boat 10 has a fuel tank 13 attached to a front part 12 of the boat body 11, and is provided with a steering handle 14 above this fuel tank 13. A saddle type seat 15 is provided behind the steering handle 14, with an engine 16 provided beneath the seat 15, an engine intake structure (engine structure for a small boat) 20 provided at a left side of the engine 16, a propulsion unit chamber 23 provided on a stern 22 behind the engine 16, and a jet propulsion unit 24 provided on the propulsion unit chamber 23. The body 11 forms a boat bottom 26 side with the hull 25, and a deck 27 overlaps this hull 25.

The jet propulsion unit 24 has a housing 29 extending rearwards from an inlet 28 of the boat bottom 26, with an impeller 31 being rotatably attached inside the housing 29, the impeller 31 being connected to a drive shaft 32 of the engine 16. By rotating the impeller 31 with the engine 16, water is taken in from the inlet 28 of the boat bottom 26, and the taken in water passes through the housing 29 and is introduced to a steering nozzle as jet water.

Jet water that has been introduced to the steering nozzle 33 causes the small boat to travel by being sprayed from a rear end part of the steering nozzle 33.

Figure 2:
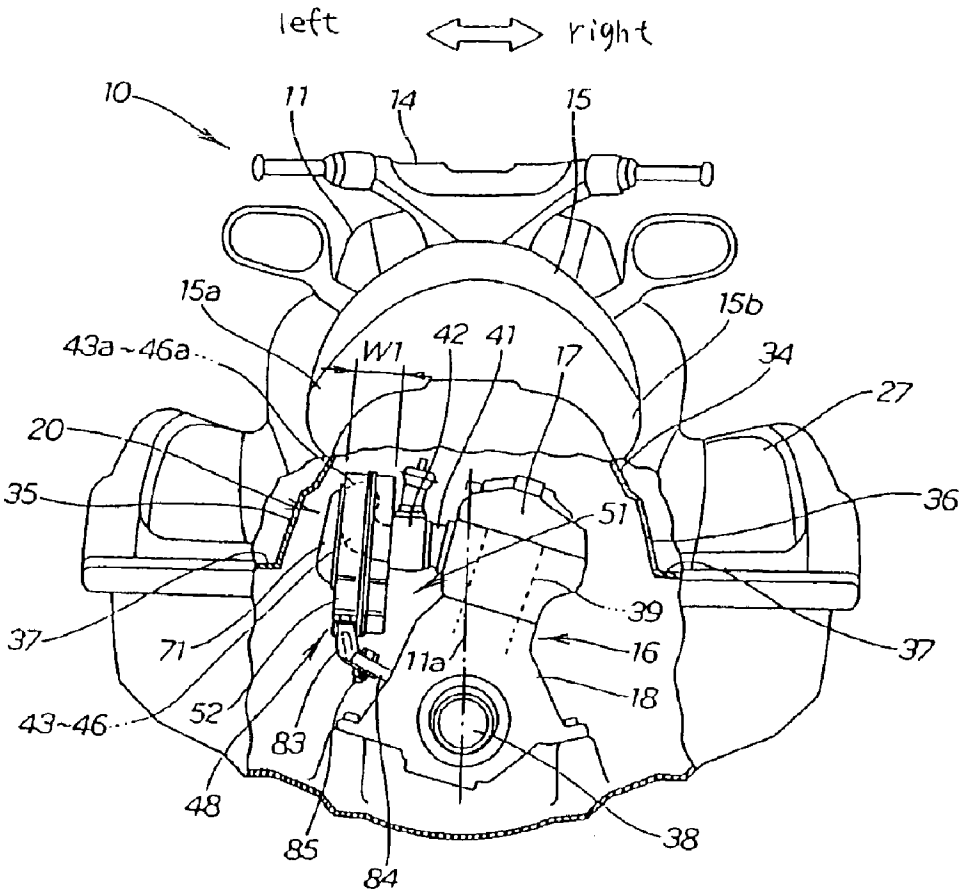
FIG. 2 is a rear view of a small boat provided with the engine intake structure of the present invention.

FIG. 2 is a rear view of a small boat provided with the engine intake structure of the present invention.

A deck upper end 43 is formed substantially in the center of a deck 72 of the small boat 10, the saddle type seat 15 is mounted on the deck upper end 34, and within the deck upper end 34, in a state where left and right side walls 35 and 35 are inclined outwards from sections close to left and right edges 15*a*, 15*b* of the seat 15 and extend downwards to footrest sections 37, 37 of the deck 27. An upper part 17 of the engine 16 is arranged between the left and right side walls 35, 36, and the engine intake structure of the small boat is provided between the upper part 17 of the engine 16 and the left side wall 35.

The engine intake structure 20 for a small boat has the engine 16 mounted below the seat 15 so that a crankshaft 38 is oriented in the longitudinal direction of the boat body 11 (refer also to FIG. 1), with a plurality (four) of cylinders 39 . . . provided in the engine 16 (refer also to FIG. 1) arranged facing upwards, intake passages 41 . . . respectively extending in the left direction (side direction) from these cylinders 39 . . . , and intake pipes (that is, air funnels) 43, 44, 45, 46) connecting via a carburetor 42 to the intake passages 41 . . . . Intake ports 43*a*, 44*a*, 45*a*, 46*a* (refer also to FIG. 3) of these intake pipes 43, 44, 45, 46 are housed in an intake box 48, and the intake box 48 is provided in a space 51 between the left side wall 35 of the deck 72 (boat body side wall) and the upper part 17 of the engine 16.

The engine 16 is inclined to the right of the boat body 11, the space 51 is secured between the upper part 17 of the engine 16 and the left side wall 35, and the intake box 48 is arranged in this space 51. In this way, since the intake box 48 is arranged in the space 51 between the upper part 17 of the engine 16 and the left sidewall 35, it is possible to keep the width W1 of the intake box 48 small.

Figure 3:
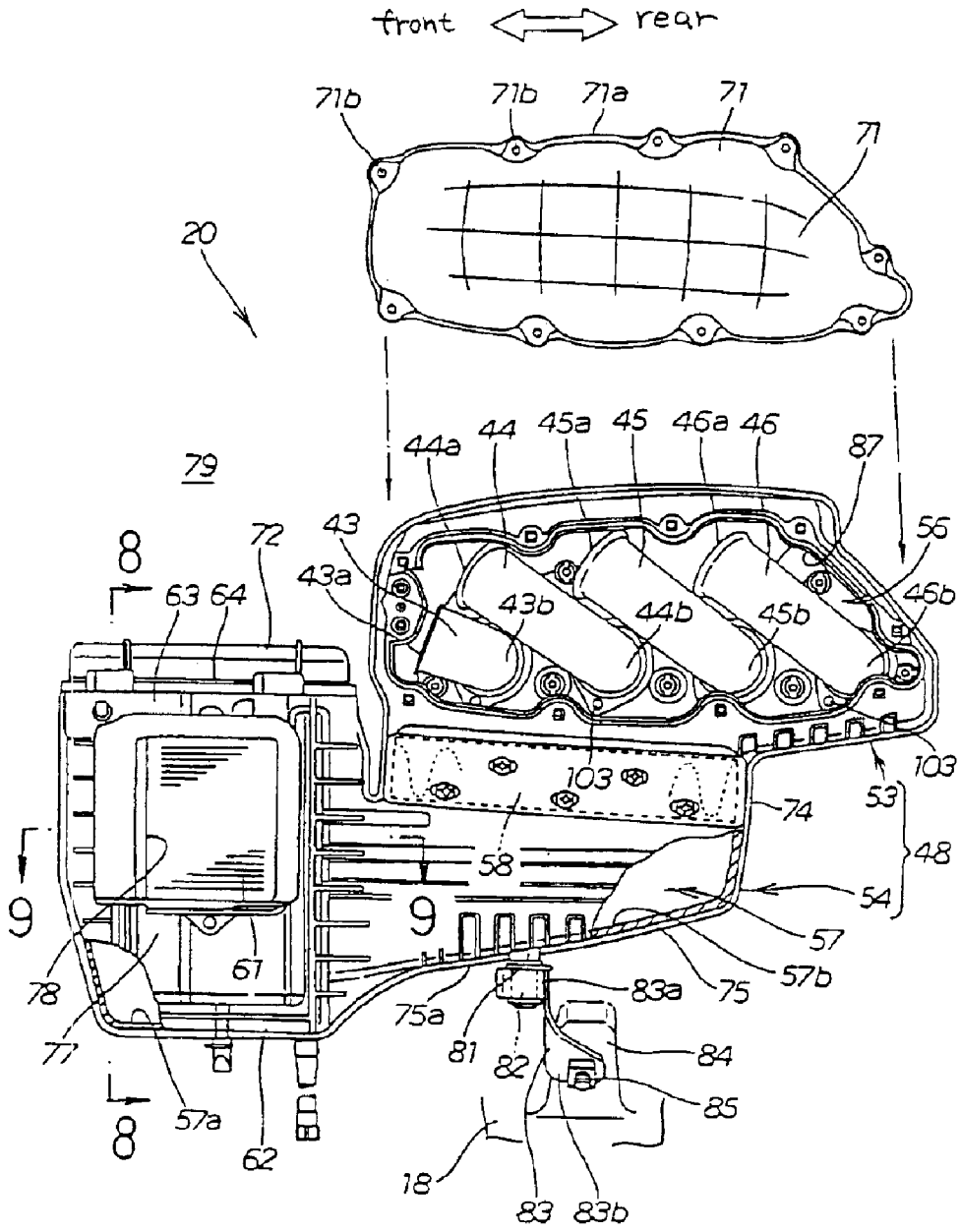
FIG. 3 is a side view showing the engine intake structure for a small boat of the present invention.

FIG. 3 is a side view showing the engine intake structure for a small boat of the present invention. In the following, the intake pipes 43, 44, 45 and 46 will be described as a first intake pipe 34, a second intake pipe 44, a third intake pipe 45 and a fourth intake pipe 46.

The engine intake structure 20 for a small boat is constructed with an upper intake section 53, housing intake ports 43*a*–46*a* of the first to fourth intake pipes 43–46, and a lower intake section 54, extending downwards from the upper intake section 53, provided in the intake box 48, with an inner space 56 of the lower intake section and an inner space 57 of the upper intake section 53 being partitioned by a mesh member (flame arrestor) 58. A plate-shaped air cleaner element is arranged in the inner space 56 of the lower intake section 54, so that after external air flows into the inner space 56 of the lower intake section 54 via the plate-shaped air cleaner element 61, the air flows to the upper intake section 53.

In this way, the intake box 48 extends in the vertical direction, and the intake ports 43*a*–46*a* of the first to fourth intake pipes 43–46, and the air cleaner element 61, are efficiently housed in the upper intake section 53 and the lower intake section 54. As a result, the width of the intake box 48 is kept small, and the intake box 48 is reduced in size. It therefore becomes possible to arrange the intake box 48 in the space 51 between the left side wall (boat body side wall) 35 of the deck 27 and the upper section 17 of the engine 16. Therefore, when determining the layout (arrangement) of components, since it is not necessary to ensure a large space for the intake box 48, it is possible to keep the time spent studying alternative layouts is short.

The intake box 48 is attached to the carburetor 42 . . . side (refer to FIG. 2), a lid body 71 is removably attached to the intake box 48, and a cover 72 is provided on an upper front part of the intake box, namely on the upper part 63 of a protruding section 62. When the intake box 48 is attached to the carburetor 42 . . . side (refer to FIG. 2), the lid body 71 is arranged facing towards the left sidewall 35 of the deck 27 (refer to FIG. 2).

The intake box 48 is made up of the upper intake section 53 housing the first to fourth intake pipes 43–46, and the lower intake section 54 extending downwards from the upper intake section 53. The upper intake section 53 is provided with an upper inner space 56, while the lower intake section 54 is provided with a lower inner space 57. The lower intake section 54 is made up of a projection section 75 projecting downwards from the upper intake section 53, and an extending section 62 extending forwards from this projection section 75.

A front half section 57*a* of the lower inner space 57 is formed inside the extending section 62, and a rear half section 57*b* of the lower inner space 57 is formed inside the projection section 75. The air cleaner element is provided in an inner part of the extending section 62, that is, the front half section 57*a* of the lower inner space 57, and an introduction opening 78 facing into the front half section 57*a* of the lower inner space 57 is provided in a left side wall 77 of the extending section 62.

Using this intake box 48, the engine intake structure 20 for a small boat has part of the intake box 48 as an extending section 62 extending forwards from the first intake pipe 43, with an insertion opening 64 (refer also to FIG. 4) provided in an upper part 63 of this extending section 62, and it is possible to insert the plate-shaped air cleaner element 61 into the projection section (intake box) 48 almost vertically from this insertion opening 64.

Also, with the engine intake structure 20 for a small boat, in a state where the air cleaner element 61 has been inserted into the intake box 48, the air cleaner element 61 is pressed to the projection section (intake box) 48 by the cam member 65 . . . (refer to FIG. 4), and this cam member 65 . . . is operated by operation means 66 (refer to FIG. 4) close to the insertion section 64.

In addition, with the engine intake structure 20 for a small boat, by arranging the mesh member 58 substantially horizontally at an interface of the upper inner space 56 and the lower inner space 57*m* the upper inner space 56 and the lower inner space 57 are partitioned by the mesh member 58.

The upper inner space 56 is formed in a substantially rectangular shape looking from the side, with the first to fourth intake pipes 43–46 being housed in this upper inner space 56, each of the intake pipes 43–46 being folded in a curve close to the base sections 43*b*–46*b*, and each of the intake pipes 43–46 extending in a forward direction at an upward gradient. The intake port 43*a* of the first intake pipe 43 is made to face to a front section of the upper inner space 56*m* while the intake ports 44*a*–46*a* of the second to fourth intake pipes 44–46 are made to face an upper part of the upper inner space. By having the first to fourth intake pies 43–46 extending forwards at an upward gradient, the first to fourth intake pipes 43–46 to project a large amount to the left side from the center 11*a* of the boat body 11 (shown in FIG. 2), and the length of the first to fourth intake pipes 43–46 is ensured.

The extending section 62 extends forwards from the first intake pipe (intake pipe) 43. By having the extending section 62 extend forwards from the first intake pipe 43, the upper part 63 of the extending section 62 is arranged in front of the first intake pipe 43. In this way, the space 79 above the extending section 62 is secured. An insertion opening 64 (refer also to FIG. 4) is provided in the upper part 63 of the extending section facing to this space 79. By securing the space 79 above the insertion opening 64, it becomes possible to insert and remove the air cleaner element 61 from the insertion opening 64. By attaching the cover 72 to the upper part 63 of the extending section 62, the insertion opening 64 is covered by the cover 72.

By securing the space 79 above the cover 72, it becomes possible to easily attach and remove the cover 72.

An attachment projection 81 is formed in a bottom section 75*a* of the projection section 75, and a cylindrical attachment rubber 82 is fitted onto this projection 81. The attachment rubber 82 is a member for attachment of the intake box 48 to the engine 16.

The attachment rubber 82 is provided on the bottom section 75*a* of the projection section 75, an upper end 83*a* of an attachment bracket is fitted to the attachment rubber 82, and a lower end 83*b* of the attachment bracket 83 is attached to a projecting lug 84 using a bolt 85. The projecting lug 84 is a member integrally projecting from the crankcase 18 of the engine 16 (refer to FIG. 2).

Figure 4:
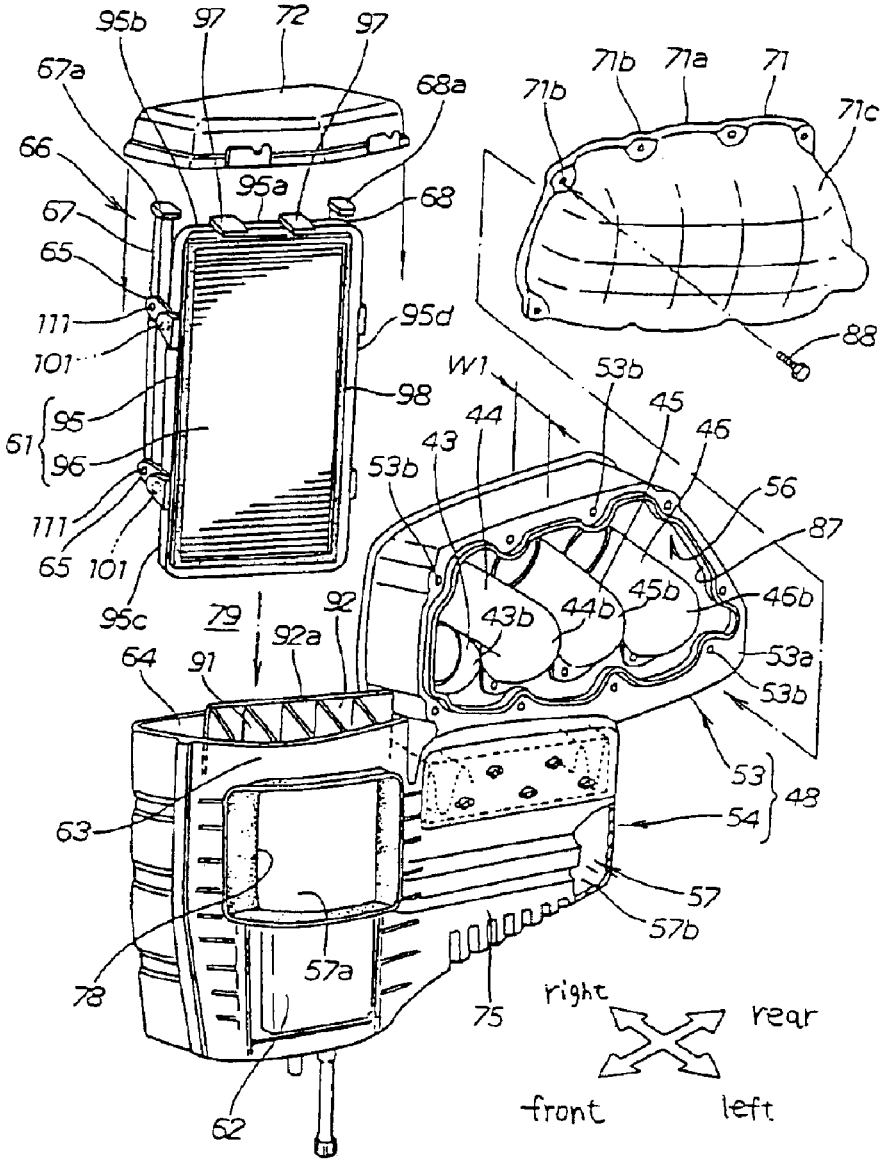
FIG. 4 is an exploded perspective view showing the engine intake structure for a small boat of the present invention.

FIG. 4 is an exploded perspective view showing the engine intake structure for a small boat of the present invention. The first to fourth intake pipes 43–46 extending to the upper inner space 56 to the side from the cylinders 39 . . . (refer to FIG. 1 and FIG. 2) are bent so as to run along the left side wall 35 (refer to FIG. 2) of the boat body 11, and housed inside the upper intake section 53 (intake box 48). Specifically, by folding the first to fourth intake pipes of the upper inner pace 56 into a curve close to the base sections 43*b*–46*b*, and running in front of and above the boat body 11 (refer to FIG. 1), the first to fourth intake pipes 43–46 extend to the front at an upward gradient. As well as securing the length of the first to fourth intake pipes 43–46, the extent to which the first to fourth intake pipes 43–46 project to the left side is kept small.

In this way, the width of the upper internal space 56 housing the first to fourth intake pipes 43–46 is kept small, and the width W1 of the upper intake section 53 (refer also to FIG. 2) is kept small. In this way, by keeping the width W1 of the upper intake section 53 small, arrangement space for the comparatively long first to fourth intake pipes 43–46, the intake box 48, can be easily secured in the space 52 (refer to FIG. 2) between the left side wall 35 (boat body side wall) of the deck 27 and the engine 16.

By having the first to fourth intake pipes 43–46 bent forwardly and upwardly with respect to the boat body 11, in other words, having the first to fourth intake pipes 43–46 extending to the front at an upward gradient, it becomes possible to arrange the intake openings 44*a*–46*a* of the first to fourth intake pipes 43–46 at a higher position than the base sections 43*b*–46*b*. By raising the height of the intake openings 44*a*–46*a*, it is possible to effectively prevent seawater or water entering.

An opening section 87 is provided in a left side wall (outer side wall) 53*a* of the upper intake section 53, and this opening section 87 faces to the upper inner space 56. A cover body 71 is provided in order to close the opening section 87. The cover body 71 has an outer periphery 71*a* formed slightly larger than the opening section 87, with attachment sections 71*b* . . . formed running along the outer periphery 71*a*, and a side wall 71*c* ballooning outwards.

Bolts 88 . . . are inserted into attachment holes 71*b* . . . of the cover body 71, and by screwing the inserted bolts 88 . . . into screw holes 53*b* . . . in the left side wall 53*a* the cover body 71 is attached to the left side wall 53*a*. In this way, the opening section is closed by the cover body 71, and sea water or water infiltrating into the first to fourth intake pipes 43–46 is prevented. Also, maintenance and checking of the inside of the upper inner space 56 are carried out by removing the cover body 71 from the left side wall 53*a* to open the opening section 87.

An insertion opening 64 is provided in the upper part 63 of the extending part 62, and the insertion opening faces a front half section 57*a* of the lower inner space 57. A support plate 92 is provided in this insertion opening, by means of ribs 91 . . . The support plate 92 is arranged oriented vertically, and is arranged at a slightly inclined angle to the left side running from the front to the rear.

The air cleaner element 61 is supported by the support plate 92. The air cleaner element 61 is provided with a rectangular frame body 95, and an air cleaner body 96 is provided inside the frame body 95. This air cleaner element 61 is a member formed into a substantially rectangular plate shape, with the frame body 95 and the air cleaner body 96. A pair of projecting lugs 97, 97 are provided on an upper end 95*a* of the frame body 95, and these projecting lugs 97, 97 project from the frame body 95 to the left side (outer side) (refer also to FIG. 8).

The air cleaner body 61 is vertically inserted into the front half body 57*a* of the lower inner space from the insertion opening 64, and the pair of projecting lugs 97, 97 are mounted on an upper end 92*a* of the support plate 92. In this way, the air cleaner element 61 is supported by the support plate 92. A sealing sponge member 98 (refer also to FIG. 8 and FIG. 9) is provided on the left sidewall 95*b* of the frame body 95.

A pair of pins 101, 101 (refer also to FIG. 8) are provided in the front side surface 95*c* of the frame body 95, and cam members 65, 65 are respectively attached in a rotatable manner to these pins 101, 101. A pair of pins 101, 101 (only one is shown in FIG. 9) are provided in the rear side surface 95*d* of the frame body 95, and cam members 65, 65 are respectively attached in a rotatable manner to these pins 101, 101. Specifically, a pair of cam members 65, 65 are attached to the front and rear side surfaces 95*c*, 95*d* of the frame body 95 in a rotatable manner.

Operation means 66 is connected to the cam members 65, 65 of the front side surface 95*c* and to the cam members 65, 65 of the rear side surface 95*d*. Specifically, the operation means 66 comprises a front operation section 67 connected to the cam members 65, 65 of the front side surface 95*c* and a rear operation section 68 connected to the cam members 65, 65 of the rear side surface 95*d* (refer also to FIG. 9).

The front and rear operation sections 67, 68 are members extending along the frame body 95, and in a state where the air cleaner element 61 has been inserted into the front half section 57*a* of the lower inner space 57, an upper end 67*a* of the front operation section 67 and an upper end 68*a* of the rear operation section 68 are respectively arranged close to the insertion opening 64. As a result, it becomes possible to easily operate the operation means 66, that is the front and rear operation sections 67, 68, at a position close to the insertion opening 64.

In this way, by forming the air cleaner element 61 in a plate shape and inserting the plate-shaped air cleaner element 61 almost vertically from the insertion opening 64, it becomes possible to keep the insertion opening 64 small. In this way, the cover 72 for covering the insertion opening 64 is made small and it is possible to easily attach and detach the cover 72. In addition, the cam members 65 . . . are operated by operation means 66 near the insertion opening 64. By operating the cam members 65 . . . near the insertion opening 64, it is possible to simplify an operation of pressing the air cleaner element 61 to the intake box 48, and an operation of opening a presser of the air cleaner element 61.

Figure 5:
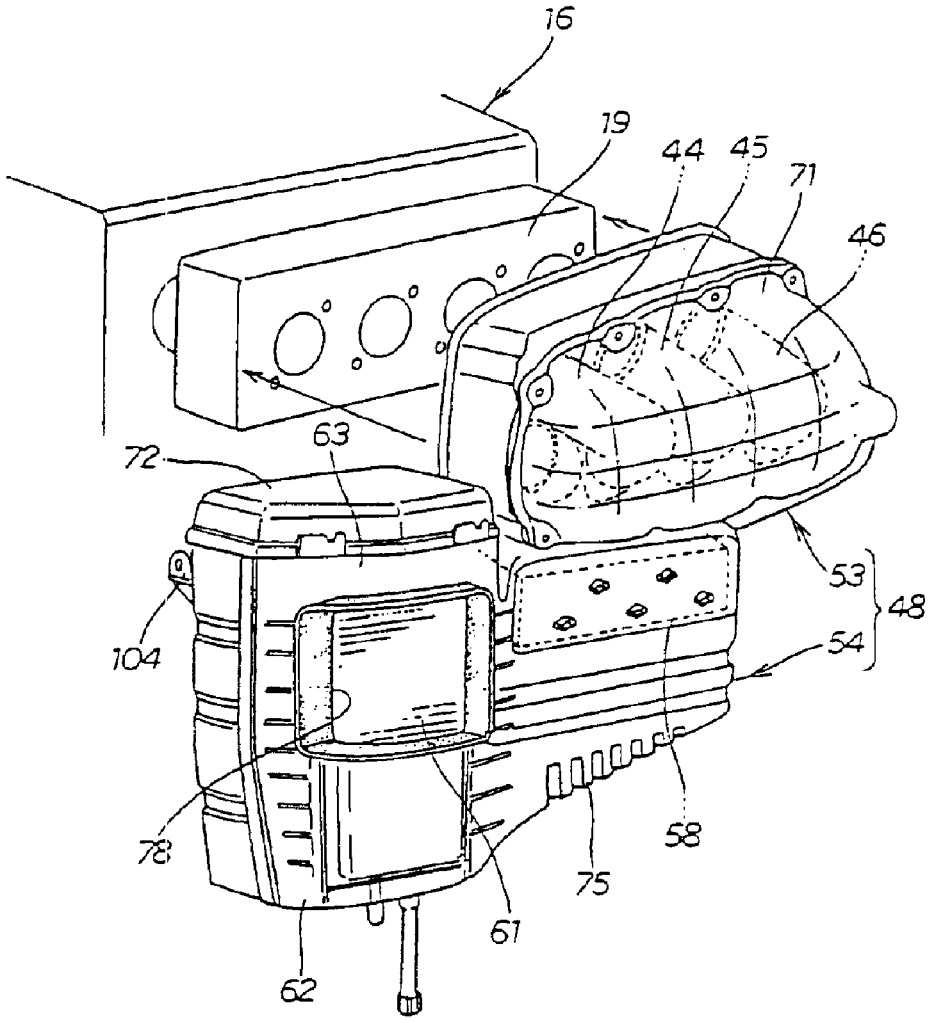
FIG. 5 is a perspective view showing the engine intake structure for a small boat of the present invention.

FIG. 5 is a perspective view showing the engine intake structure for a small boat of the present invention. The right side wall 53*c* of the upper intake section 53 comes into contact with an engine 16 side attachment surface 19, and the upper intake section 103 (refer to FIG. 3) is attached to the attachment surface 19 using a bolt 103 (refer to FIG. 3). Also, as shown in FIG. 3, the attachment rubber 82 provided on the bottom section 75*a* of the projection section 75 is attached by an attachment bracket 83 to a projecting lug 84 using a bolt 85. The projecting lug 84 is a member formed on the crankcase 18 of the engine 16 (refer to FIG. 2). Further, an attachment bracket 104 is provided on the right side wall 76 of the extending section 62, and this attachment bracket 104 is bolt fastened to the engine 16 (refer to FIG. 2). In this way, the intake box 48 is attached to the engine 16.

Figure 6:
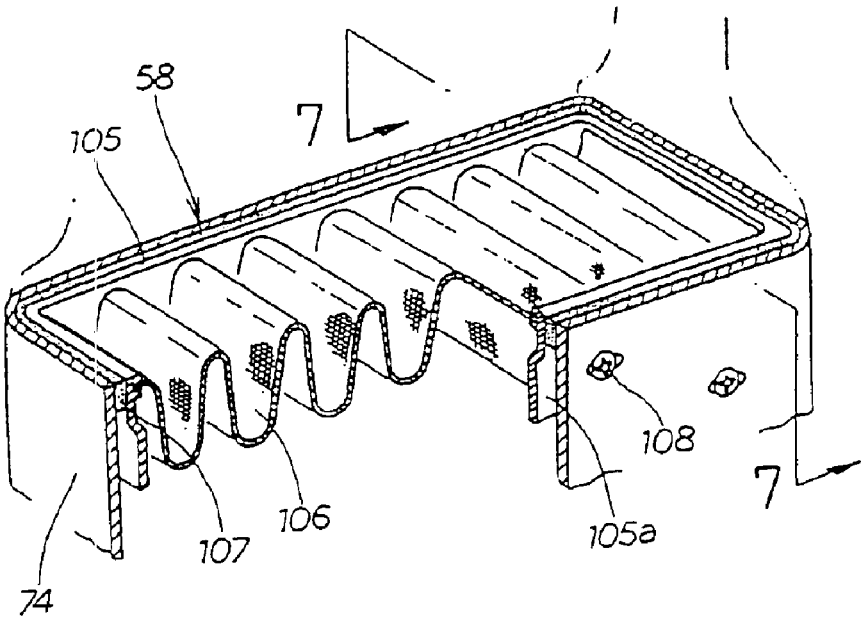
FIG. 6 is a perspective view showing a mesh member of the engine intake structure for a small boat of the present invention.

FIG. 6 is a perspective view showing a mesh member of the engine intake structure for a small boat of the present invention. The mesh member 58 is provided with a rectangular frame body 105, with a cancellate (porous) net body 106 being provided inside this frame body 105, and a sponge material provided on an outer wall 105*a* of the frame body 105. The cancellate (porous) net body 106, for example, may be formed of a mesh plate formed by knitting together (wire) and formed into an undulating shape in the longitudinal direction. By forming the net body 106 into an undulating shape, a large surface area is ensured for the net body 106.

Figure 7:
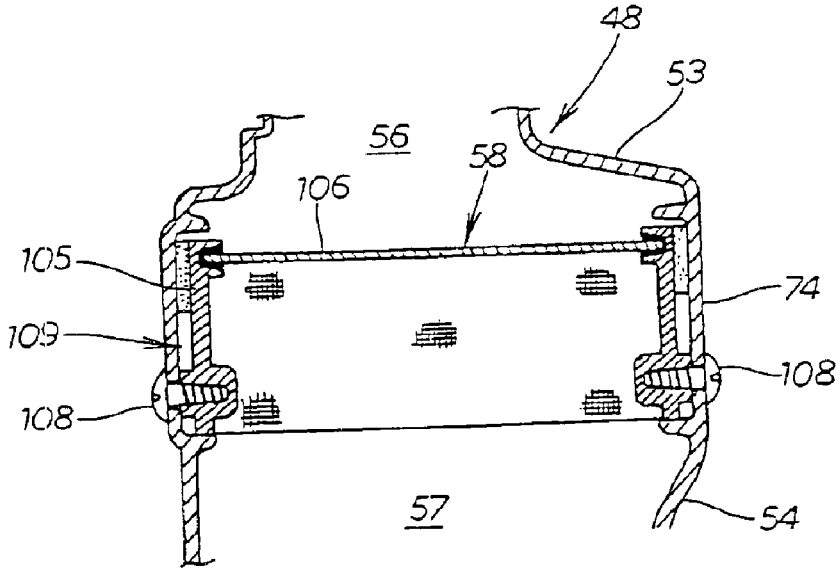
FIG. 7 is a cross sectional drawing along line 7—7 in FIG. 4.

FIG. 7 is a cross sectional drawing along line 7—7 in FIG. 6. The frame body 105 is arranged at an interface section 74 between the upper inner space 56 and the lower inner space 57 of the intake box 48, and the frame body 105 is attached using screws at the interface section 74. At this time, the outer periphery of the sponge material 107 is pressed against the inner wall of the interface section 74, and a gap 109 between the outer wall of the frame body 105 and the inner wall of the interface section 74 is blocked up by the sponge material 107.

In this way, by attaching the frame body 105 at an interface of the upper inner space 56 and the lower inner space 57 of the intake box 48, the upper inner space 56 and the lower inner space 57 of the intake box 48 are partitioned by the mesh member 58. The mesh member 58 also acts as a flame arrester.

Figure 8:
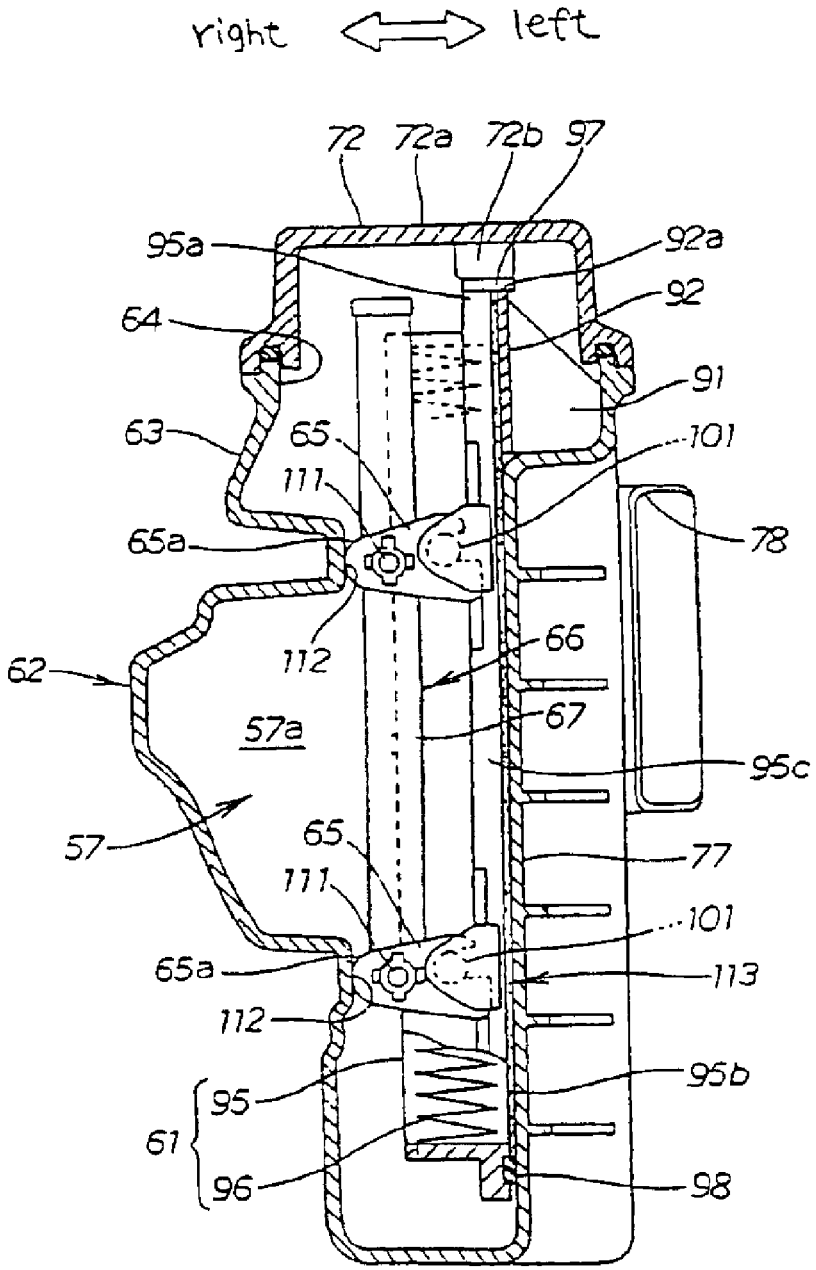
FIG. 8 is a cross sectional drawing along line 8—8 in FIG. 3.
Figure 9:
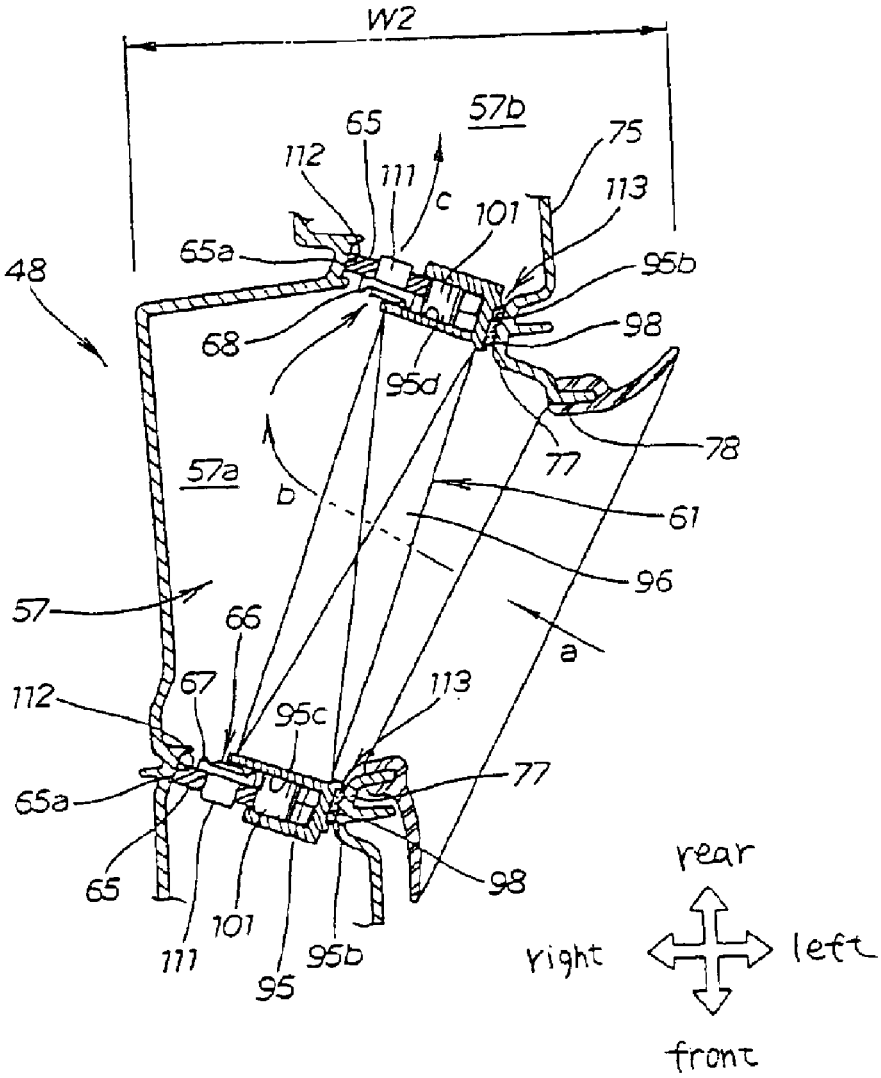
FIG. 9 is a cross sectional drawing along line 9—9 in FIG. 3.

FIG. 8 is a cross sectional drawing along line 8—8 in FIG. 3.

The air cleaner body 96 is attached inside the frame body 95 of the air cleaner element 61, and a pair of projecting lugs 97, 97 (refer also to FIG. 4) project from the frame body 95 to the left side on an upper end 95*a* of the frame body 95. Also, a sealing sponge material 98 is provided on the left sidewall 95*b* of the frame body 95.

A pair of pins 101, 101 are provided in the front side surface 95*c* of the frame body 95, and cam members 65, 65 are respectively attached in a rotatable manner to these pins 101, 101. Similarly, a pair of pins 101, 101 (only one is shown in FIG. 9) are provided on the rear side surface 95*d* of the frame body 95, and cam members 65, 65 are respectively attached in a rotatable manner to these pins 101, 101.

The cam members 65, 65 of the front side surface 95*c* are rotatably connected to attachment pins 111, 111 of the front operation section 67. Similarly, the cam members 65, 65 of the rear side surface 95*d* are rotatably connected to attachment pins 111, 111 of the rear operation section 68 (refer to FIG. 9). The cam members 65 are provided with cam surfaces 65*a* close to the attachment pins 111, 111.

On the other hand, the extending section 62 is provided with convex sections 112 . . . at locations corresponding to the cam surfaces 65*a* . . . . The convex sections 112 . . . are at locations projecting to an inner part of the extending section 62. My mounting the cam surfaces 65*a* . . . of the cam members 65 . . . on the convex sections 112 . . . , the pins 101 . . . are pressed towards the left side wall 77 of the extending section 62 by the cam members 65 . . . .

The air cleaner body then moves towards the left sidewall 77, and the sponge material 98 is pressed against the support plate 91 and the left side wall 77. Therefore a gap 113 between the air cleaner element 61 and the left sidewall 77 is blocked up by the sponge material 98.

A projection 72*b* is provided on an upper part 72*a* of the cover 72, and this projection 72*b* projects towards the front and rear operation sections 67, 78 (for the rear operation section 68, refer to FIG. 9). Therefore, by blocking up the insertion opening 64 of the extending section 62 with the cover 72, the projection 72*b* of the cover 72 is brought into contact with the pair of projecting lugs 97, 97, and the air cleaner element is prevented from coming out.

The insertion opening 64 is provided in the upper part 63 of the extending part 62, the insertion opening faces a front half section 57*a* of the lower inner space 57, and the support plate 92 is provided in the insertion opening 64. A pair of projecting lugs 97, 97 are provided on an upper end 92*a* of the support plate, and the air cleaner element 61 is supported on the support plate 92. Upper ends 67*a*, 68*a* (for the upper end 68*a*, refer to FIG. 4) of the front and rear operation sections 67, 68 (for the rear operation section refer to FIG. 9) are arranged close to the insertion opening 64, and by pressing the front and rear upper ends 67*a*, 68*a*, the front and rear cam members 65 . . . and the pins 101 . . . are rotated downwards axially.

In this way, the cam surfaces 65*a* . . . of the cam members 65 . . . rise up on the convex sections 112 . . . , and the pins 101 . . . are pressed towards the left side wall 77 by the cam members 65 . . . . The air cleaner body 61 then moves towards the left sidewall 77, and the sponge material 98 is pressed against the support plate 91 and the left sidewall 77. Therefore a gap 113 between the air cleaner element 61 and the left sidewall 77 is blocked up by the sponge material 98.

FIG. 9 is a cross sectional drawing along line 9—9 in FIG. 3. The cam surfaces 65*a* . . . of the cam members 65 . . . rise up on the convex sections 112 . . . , and the pins 101 . . . are pressed towards the left side wall 77 by the cam members 65 . . . . The air cleaner body then moves towards the left sidewall 77, and the sponge material 98 is pressed against the support plate 91 and the outer sidewall 77. In this way, a gap 113 between the air cleaner element 61 and the outer sidewall 77 is blocked up by the sponge material 98.

In this state, the air cleaner element 61 is arranged vertically, and is arranged at a slightly inclined angle to the left side extending from the front to the rear of the boat. In this manner, by arranging the plate-shaped air cleaner element 61 running along the left sidewall of the engine 16 (refer to FIG. 1 and FIG. 2), the width W2 of the extending section 62, namely the width of the intake box 48 is kept small.

It therefore becomes possible to provide the intake box 48 in the space 51 between the left side wall (boat body side wall) 35 of the deck 27 and the upper section 17 of the engine 16, as shown in FIG. 2. Therefore, when determining layout of components, since it is not necessary to ensure a large space for the intake box 48 it is possible to keep the time spent studying the layout short.

With the intake box having this type of structure, air from the introduction port 78 of the extending section 62 is introduced inside in the direction of arrows a, and the introduced air passes through the air cleaner element 61 and is introduced to the inside of extending section 62, namely to the front half section 57*a* of the lower space 57, in the direction of arrows b. Dust particles etc. in the air are removed by the air cleaner element 61, and it becomes possible to introduce that air into the front half section 57*a* of the lower space 57.

Air that has been introduced to the front half section 57*a* of the lower space 57 is introduced into the projection section 75, that is, in the direction of arrow c to the rear half section 57*b* of the lower space. Air that has been introduced to the rear half section 57*b* of the lower space 57 is introduced through the mesh member 58 (refer to FIG. 6 and FIG. 7) into the upper internal space 56 (refer to FIG. 3). Air that has been introduced to the upper internal space 56 is introduced into the first to fourth intake pipes 43–46 by means of the intake ports 43*a*–46*a* (refer to FIG. 3) of the first to fourth intake pipes 43–46.

Figure 10A:
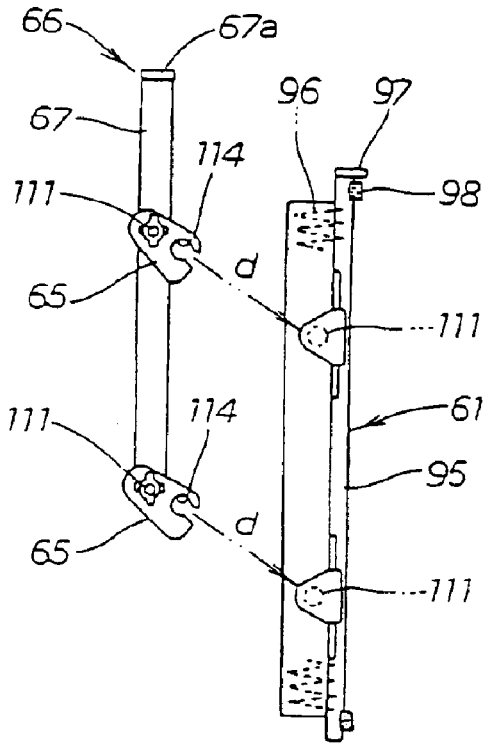
FIGS. 10(*a*) and (*b*) are drawings for describing an example of the engine intake structure of the present invention where an air cleaner element is inserted.
Figure 10B:
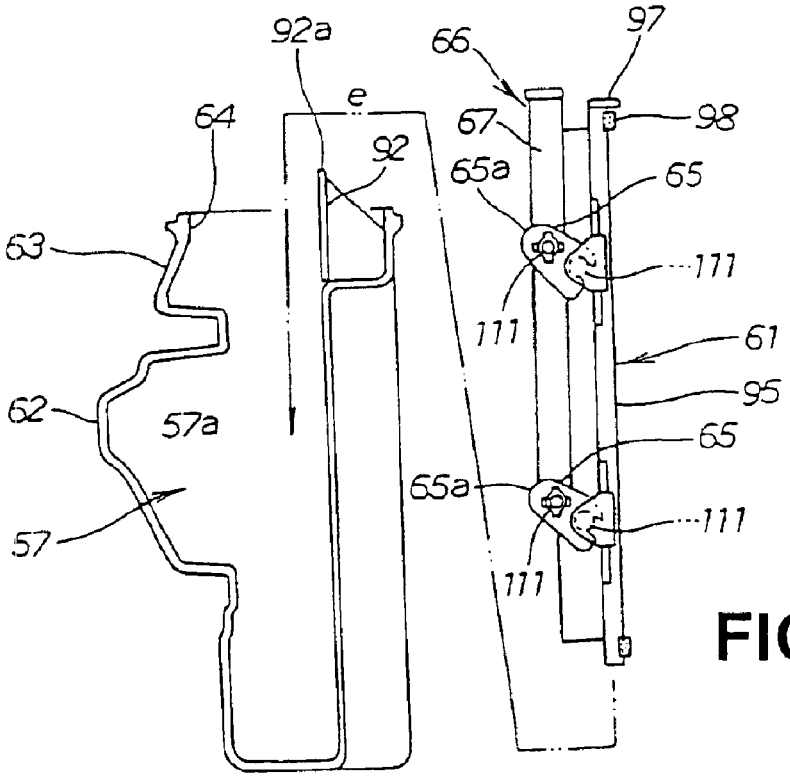

Next, operation of the engine intake structure for a small boat of the present invention will be described based on FIG. 10–FIG. 12. First of all, a sequence for assembly of the air cleaner element 61 will be described based on FIGS. 10(*a*) and (*b*) and FIGS. 11(*a*) and (*b*). FIG. 10(*a*) and FIG. 10(*b*) are drawings for describing an example of the engine intake structure of the present invention where an air cleaner element is inserted. In FIG. 10(*a*), the cam members 65, 65 are rotatably attached to attachment pins 111, 111 of the front operation section 67. Similarly, the cam members 65, 65 are rotatably attached to attachment pins 111, 111 of the rear operation section 68 (only one is shown in FIG. 9).

The front and rear operation sections are assembled in the air cleaner element 61. Specifically, engagement sections 114, 114 of cam members 65, 65 are respectively attached to a pair of pins 101, 101 of the front side surface 95*c* of the frame body 95 in a rotatable manner as shown by arrows d. Similarly, engagement sections 114, 114 of cam members 65, 65 are respectively attached to a pair of pins 101, 101 (only one is shown in FIG. 9) of the rear side surface 95*d* of the frame body 95 in a rotatable manner as shown by arrows d.

In FIG. 10(*b*), after the front and rear operation section 67, 68 and the cam members have been assembled in the air cleaner element 61, the air cleaner element 61, front and rear operation sections 67, 68, and cam members 65 are inserted from the insertion opening 64 of the extending section 62 into the inside of the extending section, namely the front half section 57*a* of the lower inner space 57, as shown by arrows e.

Figure 11A:
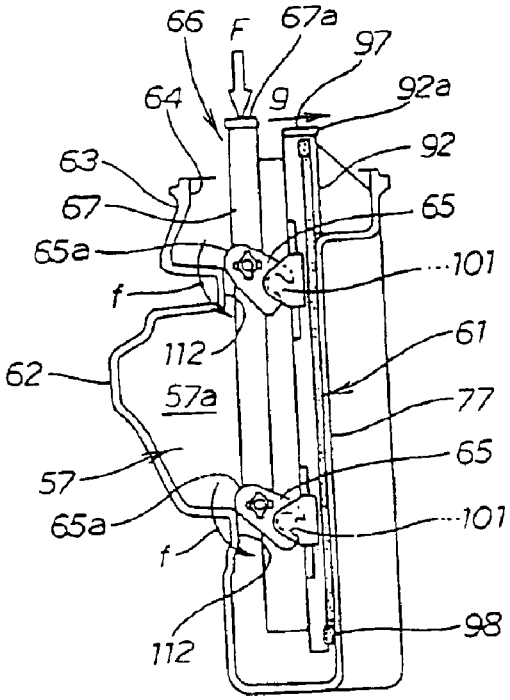
FIGS. 11(*a*) and (*b*) are drawings for describing an example of the engine intake structure of the present invention where an air cleaner element is attached.
Figure 11B:
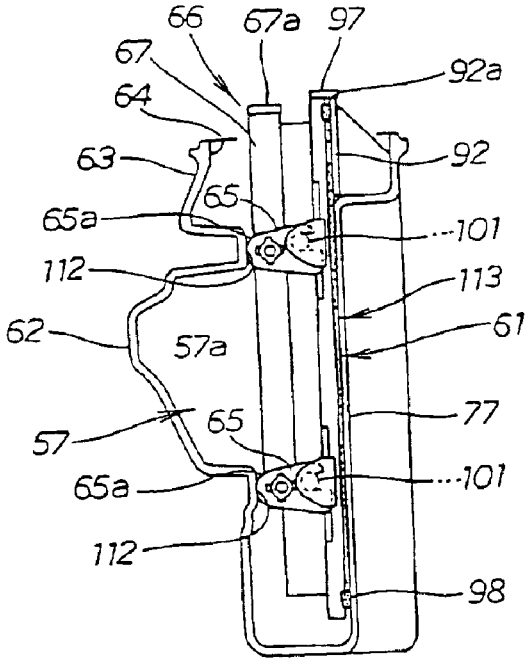
Figure 12:
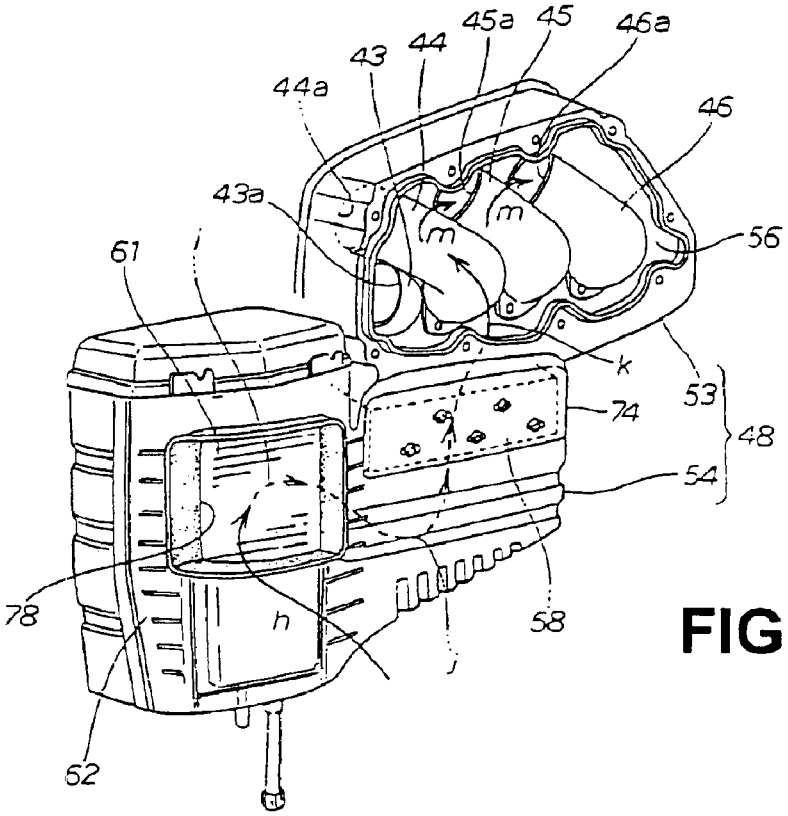
FIG. 12 is a drawing for describing the flow of air of the engine intake structure of the present invention.
Figure 13:
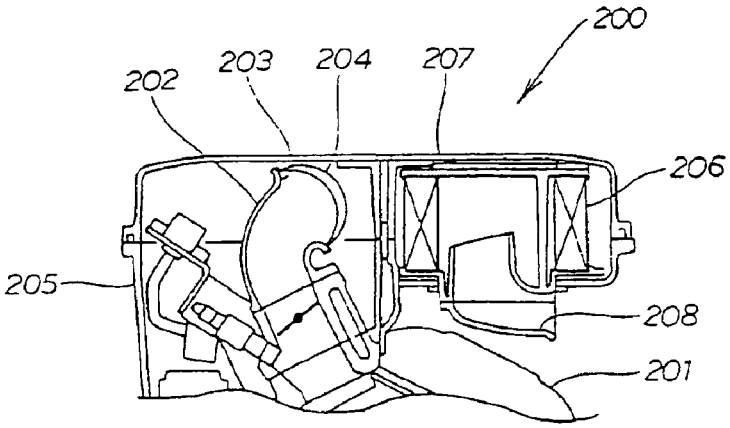
FIG. 13 BACKGROUND ART
FIG. 13 is a reproduction of FIG. 7(*a*) of the background art.

FIG. 11(*a*) and FIG. 11(*b*) are drawings for describing an example of the engine intake structure of the present invention where an air cleaner element is attached. In FIG. 1(*a*), the air cleaner body 61 is arranged in the front half body 57*a* of the lower inner space 57, and the pair of projecting lugs 97, 97 of the air cleaner element 61 (refer to FIG. 4) are placed on an upper end 92*a* of the support plate 92. In this way, the air cleaner element 61 is supported by the support plate 92.

Upper ends 67*a*, 68*a* (for the upper end 68*a*, refer to FIG. 4) of the front and rear operation sections 67, 68 (for the rear operation section refer to FIG. 9) are arranged close to the insertion opening 64. In this state, pressing force F acts on the front and rear upper ends 67*a*, 68*a*, and the front and rear upper ends 67*a*, 68*a* are pressed down. By pressing the front and rear upper ends 67*a*, 68*a* down, the front and rear cam members 65 . . . rotate downwards axially as shown by the arrows f.

In this way, the cam surfaces 65*a* . . . of the cam members 65 . . . rise up on the convex sections 112 . . . , and the pins 101 . . . are pressed towards the left side wall 77 by the cam members 65 . . . . The air cleaner element 61 is moved towards the left side wall 77, as shown by the arrow g.

In FIG. 11(*b*), the air cleaner body 61 then moves towards the left sidewall 77, and the sponge material 98 is pressed against the support plate 92 and the left sidewall 77. Therefore a gap 113 between the air cleaner element 61 and the left sidewall 77 is blocked up by the sponge material 98. In this way, the air cleaner element 61 is assembled inside the extending section 62, and the assembly operation is complete.

Next, an example of introducing air into the first to fourth intake pipes 43–46 will be described based on FIG. 12. FIG. 12 is a drawing for describing the flow of air of the engine intake structure of the present invention. Air from the introduction port 78 of the extending section 62 is introduced inside as shown by arrows h and the introduced air passes through the air cleaner element 61 and is introduced to the inside of extending section 62, namely to the front half section 57*a* (refer to FIG. 4 and FIG. 9) of the lower space 57, as shown by arrow i. In this way, by taking in air through the air cleaner element 61 into the front half section 57*a* of the lower space 57, it is possible to remove dust particles etc. in the air using the air cleaner element 61.

Air that has been introduced to the front half section 57*a* of the lower space 57 is introduced into the projection section 75, that is, to the rear half section 57*b* (refer to FIG. 4) of the lower space 57, as shown by arrow j. Air that has been introduced to the rear half section 57*b* of the lower space 57 is introduced through the mesh member 58 (refer also to FIG. 6 and FIG. 7) into the upper internal space 56, as shown by arrow k. Air that has been introduced to the upper internal space 56 is introduced into the intake ports 43*a*–46*a* of the first to fourth intake pipes 43–46, as shown by arrow m, and air that has been introduced into the intake ports 43*a*–46*a* is introduced into the first to fourth intake pipes 43–46.

With the above described embodiment, description has been given for an example of applying the engine intake structure 20 to a small boat propelled by with a jet propulsion unit 24 at the rear of a boat body 11, but this is not limiting, and it is possible to apply the present invention to other small boats.

Also, with the above-described embodiment, description has been given for an example where the engine 16 is inclined to the right side to secure a space 51, and the intake box 48 is arranged in this space. However, it is also possible to not incline the engine 16 to the right side. It is also possible to incline the engine 16 to the left and to arrange the intake box 48 in a space on the right side.

With the above described embodiment, description has been given for an example where an extending section 62 extends forwards from the first intake pipe 43, the insertion opening 64 is formed in an upper part 63 of this extending section 62, and the air cleaner element 61 is inserted from this insertion opening, but this is not limiting. It is also possible for the extending section 62 to extend rearwards from the fourth intake pipe 46.

Also, with the above-described embodiment, description has been given for an example where the air cleaner body is formed in a plate shape, but the shape of the air cleaner element 61 is not limiting and other shapes are possible.

The engine intake structure of the present invention has intake pipes extending sideways from cylinders provided in the engine, and these intake pipes are housed inside an intake box.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An engine intake structure for a boat having an engine mounted substantially in a middle of a boat body in the widthwise direction, so as to face in a longitudinal direction of the boat body, and a plurality of cylinders of the engine arranged facing upwards, the engine intake structure comprising:

intake pipes formed with intake ports extending from a side of the cylinders;

an intake box for housing the intake ports of the intake pipes inside the intake box, the intake box being arranged between a side wall of the boat body and the engine, the intake box including:

an upper intake section facing towards the intake ports and a lower intake section extending downwards from the upper intake section;

a mesh member partitioning the upper intake section and lower intake section; and an air cleaner element arranged in the lower intake section, wherein, after external air has been taken in to the lower intake section via the air cleaner element, the air flows to the upper intake section.

2. The engine intake structure for a boat as disclosed in claim 1, wherein the intake pipes extending from the side of the cylinders are bent so as to run along a side wall of the boat body.

3. The engine intake structure for a boat as disclosed in claim 2, wherein the intake pipes are bent forwardly and upwardly with respect to the boat body.

4. The engine intake structure for a boat as disclosed in claim 1, wherein the lower intake section includes an extension for holding the air cleaner element.

5. The engine intake structure for a boat as disclosed in claim 1, further comprising a cover body attached to the upper intake section, the cover body having a ballooning side wall for covering the intake pipes.

6. The engine intake structure for a boat as disclosed in claim 4, further comprising a support plate with ribs, the support plate being disposed in the extension section and extending from front to rear at a slight angle with respect to a length of the boat body.

7. The engine intake structure for a boat as disclosed in claim 4, further comprising a cover on the upper part of the extension section for covering an insertion opening.

8. The engine intake structure for a boat as disclosed in claim 1, further comprising an interface section for supporting the mesh member.

9. The engine intake structure for a boat as disclosed in claim 1, wherein a top portion of the engine is disposed on one side of the boat with respect to the longitudinal direction of the boat body, and the engine intake structure is disposed on an opposite side of the boat body.

10. The engine intake structure for a boat as disclosed in claim 1, wherein the external air flows from the air cleaner element to an under side of the mesh member, and then passes in an upward direction through the mesh member and into to the upper intake section.

11. An engine intake structure for a boat having an engine mounted substantially in a middle of a boat body in the widthwise direction, so as to face in a longitudinal direction of the boat body, and a plurality of cylinders of the engine arranged facing upwards, the engine intake structure comprising:

intake pipes formed with intake ports extending from a side of the cylinders;

an intake box for housing the intake ports of the intake pipes inside the intake box, the intake box being arranged between a side wall of the boat body and the engine, the intake box comprising:

an extension section extending either backwards or forwards from the intake pipes;

an insertion opening provided in an upper part of the extension section; and a plate-shaped air cleaner element substantially vertically inserted into the intake box from the insertion opening, and after the air cleaner element is inserted into the intake box, the air cleaner element is pressed to the intake box by a cam member, the cam member being operable by operation means adjacent to the insertion opening.

12. The engine intake structure for a boat as disclosed in claim 11, wherein the intake pipes extending from the side of the cylinders are bent so as to run along a side wall of the boat body.

13. The engine intake structure for a boat as disclosed in claim 12, wherein the intake pipes are bent forwardly and upwardly with respect to the boat body.

14. The engine intake structure for a boat as disclosed in claim 11, further comprising an upper intake section and a lower intake section, the extension section extending forwardly from the lower intake section.

15. The engine intake structure for a boat as disclosed in claim 11, further comprising at least one pin on a vertical side of the air cleaner element, the pin being pressed by the cam member.

16. The engine intake structure for a boat as disclosed in claim 11, further comprising a support plate with ribs, the support plate being disposed in the extension section and extending from front to rear at a slight angle with respect to a length of the boat body.

17. The engine intake structure for a boat as disclosed in claim 11, wherein the operating means includes a front and a rear operating section.

18. The engine intake structure for a boat as disclosed in claim 11, wherein the cam member presses against a convex section on a inner wall of the extension section.

19. The engine intake structure for a boat as disclosed in claim 14, further comprising a mesh member disposed between the upper intake section and the lower intake section.

20. The engine intake structure for a boat as disclosed in claim 19, wherein the external air flows from the air cleaner element to an under side of the mesh member, and then passes in an upward direction through the mesh member and into to the upper intake section.

* * * * *